United States Patent [19]

Dennis

[11] Patent Number: 4,705,123

[45] Date of Patent: Nov. 10, 1987

[54] CUTTING ELEMENT FOR A ROTARY DRILL BIT AND METHOD FOR MAKING SAME

[75] Inventor: Mahlon D. Dennis, Kingwood, Tex.

[73] Assignee: Strata Bit Corporation, Houston, Tex.

[21] Appl. No.: 890,285

[22] Filed: Jul. 29, 1986

[51] Int. Cl.[4] ..... E21B 10/46

[52] U.S. Cl. ..... 175/410; 29/458; 29/527.5; 51/309; 76/108 A; 408/144

[58] Field of Search ..... 175/374, 397, 409, 410, 175/412; 408/144, 145; 51/309; 76/108 A, 108 R, DIG. 11; 29/527.5, 527.3, 458

[56] References Cited

U.S. PATENT DOCUMENTS

| | | | |
|---|---|---|---|
| 4,452,325 | 6/1984 | Radd et al. | 175/412 X |
| 4,592,433 | 6/1986 | Dennis | 175/410 X |

FOREIGN PATENT DOCUMENTS

| | | | |
|---|---|---|---|
| 0074759 | 3/1983 | European Pat. Off. | 408/144 |
| 0106817 | 4/1984 | European Pat. Off. | 408/144 |

*Primary Examiner*—Stephen J. Novosad

*Attorney, Agent, or Firm*—Burns, Doane, Swecker & Mathis

[57] ABSTRACT

A cutting element comprises a stud and a cutting blank bonded to a mounting face of the stud. The stud comprises stiffening elements of a refractory carbide embedded in a body of steel. The mounting surface is formed partially of carbide and partially of steel, and the cutting blank is bonded to the steel and carbide.

21 Claims, 10 Drawing Figures

Fig. 1
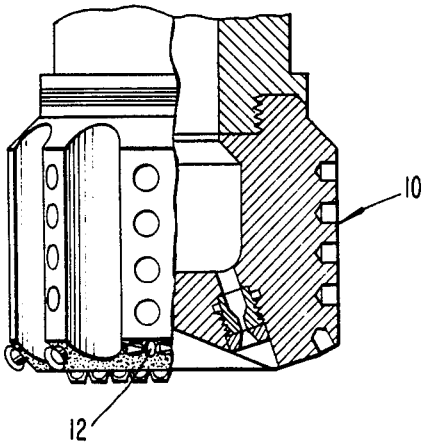
Fig. 2
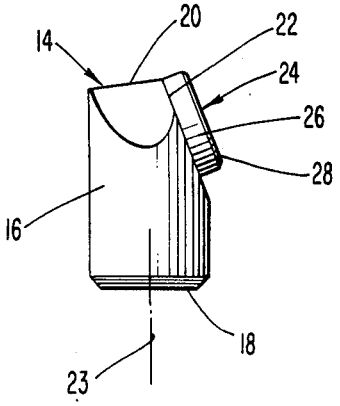
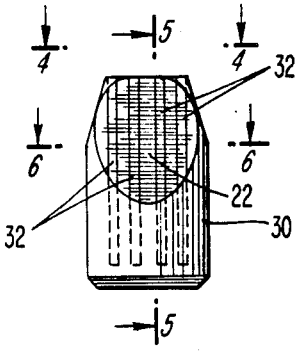
Fig. 3
Fig. 4
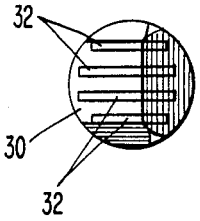
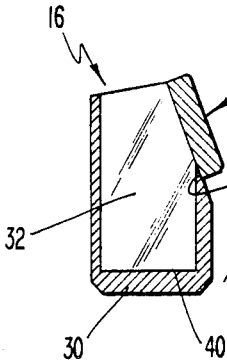
Fig. 5
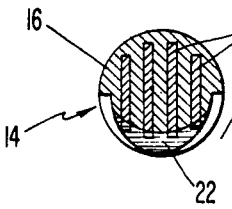
Fig. 6
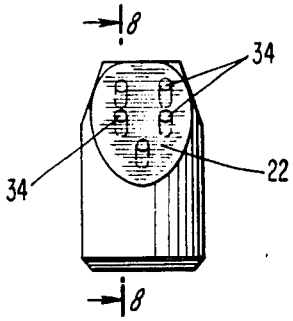
Fig. 7
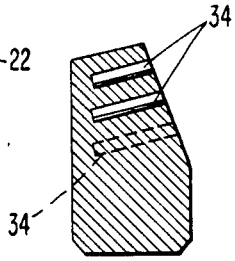
Fig. 8
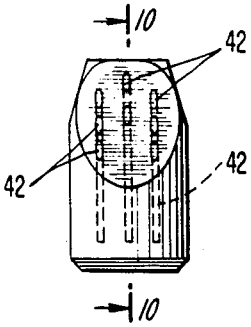
Fig. 9
Fig. 10
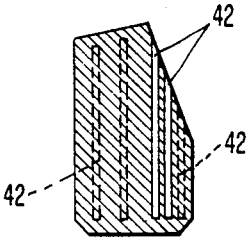

CUTTING ELEMENT FOR A ROTARY DRILL BIT AND METHOD FOR MAKING SAME

BACKGROUND AND OBJECTS OF THE INVENTION

The present invention relates to cutting elements of the type which are mounted on rotary drill bits for cutting through earth formations including rock formations, cement, plugs, etc.

Rotary drilling operations in earth formations are typically carried out using a rotary drill bit which is simultaneously rotated and advanced into the formation. Cutting is performed by cutting elements mounted on the drill bit, and the cuttings are flushed to the top of the borehole by the circulation of drilling fluid.

A conventional cutting element may comprise a cutting blank mounted on a cemented carbide stud. The blank includes a diamond disk disposed on a carbide substrate. The blank can be braze bonded to an inclined mounting face of the stud, and the stud 18 is then secured, e.g., by press-fit, shrink-fit, or brazing in a recess of the drill bit. Cutting elements of this type are disclosed, for example, in Rowley et al U.S. Pat. No. 4,073,354; Rohde et al U.S. Pat. No. 4,098,363; and Daniels et al U.S. Pat. No. 4,156,329. During the use of cutting elements of this type, cutting takes place by means of a section of the peripheral edge of the blank which is brought into contact with the formation being cut.

The stud is typically formed of a relatively ductile material such as steel or a hard substance such as a refractory carbide. The use of steel is advantageous in that it is resistant to fracture and bonds readily to the blank. On the other hand, due to its ductility, steel may not exhibit sufficient rigidity to prevent the diamond disc from breaking. That is, during a cutting operation the cutting forces acting reactively against the cutting elements will cause the ductile steel stud to deform to a greater extent than the hard diamond/carbide cutting blank. Such disparities in the amounts of deformation can cause the diamond layer to break.

Studs formed of refractory carbide are much harder and stiffer than steel, so there is less of a tendency for the diamond layer to break. However, cemented carbide is susceptible to fracture; cracks formed during a cutting operation may propogate completely thrugh the carbide, causing the stud to break apart. Also, when the blank is brazed to the mounting face of the stud, there can occur a loss of metal binder from the mounting face of the stud, thereby weakening that face and rendering it even more susceptible to fracture.

It is an object of the present invention to minimize or obviate problems of the type discussed above.

Another object is to provide a stiff, fracture-resistant stud which is highly resistant to erosion and wear and which effects a dependable bond with the blank.

SUMMARY OF THE INVENTION

These objects are achieved by the present invention which relates to a cutting element and a method of making same. The cutting element is of the type comprising a generally cylindrical shank. The shank defines a front to rear extending longitudinal axis and has a mounting face disposed at a front end of the shank. A cutting blank is mounted on the mounting face, the blank comprising a substrate having a base surface and a cutting surface. The shank comprises a body formed of a ductile material, such as steel and defining an outer generally cylindrical side surface, and a rear surface opposite the mounting face. A plurality of stiffening elements formed of a hard material, such as a refractory carbide, are embedded in the body and extend in a generally front-to-rear direction The elements are spaced inwardly from the rear surface and at least some of the stiffening elements extend to the mounting face such that the mounting face is formed partially of the ductile material and partially of the hard material. The base surface of the substrate is bonded to both the ductile and hard materials of the mounting face.

The cutting element can be fabricated by at least partially coating the stiffening elements with a high temperature-resistant material, such as a ceramic. The elements can then be embedded within the body in a casting operation or methods, such as hot isostatic pressing. The ceramic coating protects the surface of the carbide from the high temperatures of the casting operation, thereby minimizing damage thereto.

THE DRAWINGS

The objects and advantages of the invention will become apparent from the following detailed description of preferred embodiments thereof in connection with the accompanying drawings in which like numerals designate like elements, and in which:

FIG. 1 is a side elevational view, partially broken away, of a drill bit containing cutting elements according to the present invention;

FIG. 2 is a side elevational view of a cutting element according to the present invention;

FIG. 3 is a front view of the cutting element;

FIG. 4 is a top plan view of the cutting element;

FIG. 5 is a longitudinal sectional view taken along the line 5—5 FIG. 3;

FIG. 6 is a cross-sectional view taken along the line 6—6 of FIG. 3;

FIG. 7 is a front view of another embodiment of the present invention;

FIG. 8 is a longitudinal sectional view taken along the line 8—8 in FIG. 7;

FIG. 9 is a front view of yet another embodiment of the invention; and

FIG. 10 is a longitudinal sectional view taken along the line 10—10 in FIG. 9.

DETAILED DESCRIPTION OF PREFERRED EMBODIMENTS OF THE INVENTION

Depicted in FIG. 1 is a drill bit 10 in which cutting elements 12 according to the present invention are mounted in conventional fashion e.g., by a press-fit or bonding.

The cutting element comprises a stud 14 having a cylindrical side surface 16, a rear surface 18, a top surface 20, and a front mounting face 22. The mounting face 22 is inclined obliquely relative to a longitudinal axis 23 of the stud and faces in the direction of cutting when the cutting element is mounted in the drill bit.

Mounted to the mounting face 22 is a cutting blank 24. The blank 24 comprises a substrate 26 and a diamond layer 28 carried by the substrate. The substrate is preferably formed of a hard material such as a refractory carbide, e.g., cemented tungsten carbide, which is brazed to the mounting surface 22.

The stud 16 comprises a body 30 formed of a ductile material such as steel, and a plurality of stiffening elements 32 embedded wtihin the body 30. The stiffen-elements are formed of a hard material such as a refractory carbide, e.g., cemented tungsten carbide, and extend to the mounting face 22 such that the face 22 is formed partially of the ductile material of the body 30 and partially of the hard material of the stiffening elements 32. The ductile material should exhibit an elastic modulus no greater than 50% of the elastic modulus of cemented tungsten carbide having 10% cobalt.

The stiffening elements are spaced from one another and are spaced from the side and rear faces 16, 18 of the body 30.

The stiffening elements may assume various shapes and sizes, such as the plate shaped elements 32 depicted in FIGS. 3–6. Those plates 32 are parallel to each other and to the longitudinal axis 23 and extend to the top surface 20.

The plates 32 are oriented such that the forward edges 31 thereof which coincide with the mounting surface 22 extend in a front-to-rear direction. Thus, those edges will face in the direction of travel of the cutting elements during a cutting operation to provide the maximum stiffening effect to the stud.

Alternatively, the stiffening elements may comprise rods as depicted in FIGS. 7–10. As shown in FIGS. 7 and 8, the rods 34 may be oriented obliquely relatively to the longitudinal axis to form an angle of about 90° relative to the mounting face 22. Thus, the rods 34 are oriented such that their ends face in the direction of cutting to maximize the stiffening action.

Alternatively, the rods 36 (FIGS. 9, 10) can extend parallel to the longitudinal axis 23.

The stiffening elements can be cast-in-place within the stud simultaneously with the casting of the body 30, e.g., in a hot isostatic pressing step. In order to prevent the high casting temperature from damaging the surface of the stiffening elements, the latter can be coated with a protective substance, such as a ceramic or a high melting super alloy, e.g, a cobalt nutrient. Although no bonding of the stiffening elements to the body 30 will occur along the coated areas, the stiffening elements will be adequately connected to the body 30 by virtue of being mechanically trapped therein due to thermal contraction of the steel on the elements. The coated surfaces will not be damaged, thereby being able to resist the loading during cutting operations.

If desired, the rear surfaces of the stiffening elements, e.g., the rear surfaces 40 of the plates 32 and the rear surfaces 42 of the rods 34, 36 could be uncoated so as to be bonded to the body 30 to maximize securement. Any damage occurring to the rear surfaces 40, 42 would be of little consequence since those rear surfaces are not required to withstand high loads.

If desired, the thickness of the coating could be made sufficiently thin to ensure that the coating becomes fully dissipated after a predetermined time period during the casting step, whereupon bonding between all surfaces of the stiffening elements and the body 30 would eventually occur, but with less damage occurring to those surfaces since the temperatures would be reduced by that time.

Importantly, the bonding which occurs between the blank 24 and the mounting surface 22 at the rear-most end 44 of the blank (i.e., the end located farthest from the top end 20 of the stud), occurs between the braze material and the ductile material (rather than with the hard material). That rear-most end of the blank constitutes an area of the stud which is most prone to stress fractures. By assuring that the bonding occurs with the ductile material, i.e., the more flexible material, the risk of stress fractures is more reduced than if the bonding were to occur with the material of the hard stiffening element.

It will be appreciated that a cutting element according to the present invention exhibits a high degree of stiffness, due to the presence of the stiffening elements, to prevent the diamond layer of the blank from breaking during a cutting operation. This is achieved, moreover, in a stud which exhibits a high degree of impact strength and fracture toughness due to the ductility of the body 30. During use of the cutting element in a cutting operation, the presence of materials of different elastic modulus, i.e., the hard materials of the stiffening elements and the more ductile body, respectively, will cause the cutting-induced forces acting on the cutting element to be attenuated. That is, a dampening of those forces is produced and shock waves will be scattered. Since the hard stiffening elements are embedded within a ductile steel matrix, the latter will absorb shocks and thereby resist fracturing of the hard stiffening elements. Any fractures which do occur in the hard stiffening elements will terminate at the outer surface of the stiffening elements, i.e., the cracks will not propogate into the steel body and across the stud; thus, the stud will not fracture into pieces as can occur in the case of studs formed entirely of a hard substance.

When the blank 24 is brazed to the stud, the substrate will adhere to both the hard and ductile surfaces present at the mounting face 22. The presence of the ductile material will enhance the bond because any residual stresses remaining after the brazing will be low, since the thermal expansion of the brazing material will be closer to the ductile steel material than to the hard carbide. Therefore, the relative amounts of thermal contraction of the steel and the brazing material during cooling will be comparable and will produce a bond having less residual stress than the bond between the brazing material and the stiffening elements. Furthermore, the steel will exhibit better "wetability" to the brazing material than will the carbide, so that the steel will bond more readily than the carbide.

Installation of the stud in the drill bit will be facilitated by the ability of the ductile body 30 to deform plastically.

Since the side surface of the stud is formed of steel, it becomes easier to bond to the stud a reinforcing shroud such as the type disclosed in pending U.S. application Ser. No. 614,232 filed May 25, 1984, and now U.S. Pat. No. 4,632,196, which is arranged to underlie and support the cutting blank. That is, such a shroud bonds more readily to steel than to carbide.

In certain instances it may be desirable to employ only a single stiffening element instead of a plurality thereof.

The stiffening elements can be mounted in a stud of the type wherein the mounting face is oriented perpendicularly relative to the longitudinal axis of the stud. In such a case the stiffening elements would extend all the way to the mounting face so that the cutting blank is mounted to both carbide and steel. The stiffening elements would probably not be oriented at an angle relative to the stud axis in the manner depicted in FIG. 8.

Although the present invention has been described in connection with preferred embodiments thereof, it will be appreciated by those skilled in the art that modifications, additions, substitutions, and deletions not specifically described may be made without departing from the spirit and scope of the invention as defined in the appended claims.

What I claim is:

1. A cutting element of the type comprising a generally cylindrical shank defining a front-to-rear extending longitudinal axis and having a mounting face disposed at a front end of said shank, and a cutting blank mounted on said mounting face, said blank comprising a substrate having a base surface and a cutting surface, the improvement wherein said shank comprises:

a body formed of a ductile material and defining an outer generally cylindrical side surface, and a rear surface opposite said mounting face, and at least one stiffening element formed of a hard material embedded in said body and extending in a generally front-to-rear direction, said at least one element spaced inwardly from said rear surface and extending to said mounting face such that said mounting face is formed partially of said ductile material and partially of said hard material, said base surface of said substrate being bonded to both said ductile and hard materials of said mounting face.

2. A cutting element according to claim 1, wherein said mounting face is inclined obliquely relative to said longitudinal axis.

3. A cutting element according to claim 1, wherein there are a plurality of said stiffening elements.

4. A cutting element according to claim 3, wherein said stiffening elements are spaced apart in non-interconnected relationship.

5. A cutting element according to claim 1, wherein said ductile material comprises steel and said hard material comprises a refractory carbide.

6. A cutting element according to claim 5, wherein said refractory carbide comprises cemented tungsten carbide.

7. A cutting element according to claim 3, wherein said stiffening elements comprise plates.

8. A cutting element according to claim 7, wherein said plates are flat and parallel to said longitudinal axis.

9. A cutting element according to claim 3, wherein said stiffening elements comprise rods.

10. A cutting element according to claim 9, wherein said rods extend parallel to said longitudinal axis.

11. A cutting element according to claim 9, wherein said rods are oriented at ninety degrees relative to said mounting surface.

12. A cutting element according to claim 11, wherein said mounting face is oriented at an acute angle relative to said longitudinal axis, said rods extending rearwardly from said mounting face.

13. A cutting element according to claim 2, wherein a rear-most portion of said base surface of said blank is bonded to said ductile material.

14. A cutting element according to claim 1, wherein said at least one stiffening element is spaced from said rear surface of said body.

15. A cutting element of the type comprising:

a generally cylindrical shank defining a longitudinal axis and having a mounting face disposed at a front end of said shank and oriented obliquely relative to said longitudinal axis, and a cutting blank bonded to said mounting face, said blank comprising a substrate having a base surface and a cutting surface, the improvement wherein said shank comprises:

a body formed of steel and defining an outer generally cylindrical side surface and a rear surface opposite said mounting face, and a plurality of stiffening elements formed of a refractory carbide embedded in said body and extending in a generally front-to-rear direction, said elements spaced inwardly from said side surface, at least some of said stiffening elements extending to said mounting face such that said mounting face is formed partially of steel and partially of refractory carbide, said cutting blank bonded to both said steel and refractory materials of said mounting face such that a rearwardmost portion of said blank is bonded to steel.

16. A cutting element according to claim 15, wherein said stiffening elements are spaced from said rear surface of said body.

17. A method of making a cutting element comprising the steps of:

providing at least one stiffening element formed of a hard material, at least partially coating said stiffening elements with a high temperature-resistant material, casting a body from a ductile material with said stiffening element embedded therein, said body formed with a generally cylindrical outer surface defining a longitudinal axis, a mounting face disposed at a front end of said body, and a rear surface opposite said mounting face, said stiffening element extending in a generally front-to-rear direction and spaced inwardly from said side surface, said stiffening element extending to said mounting face such that said mounting face is formed partially of said ductile material and partially of said hard material, and bonding a cutting blank to both said ductile and hard material of said mounting face.

18. A method according to claim 17, wherein said stiffening element includes a rear end spaced inwardly from said rear surface, said rear end being uncoated with said temperature resistant material.

19. A method according to claim 18, wherein said temperature resistant material comprises a ceramic material.

20. A method according to claim 17, wherein said ductile material is steel and said hard material is a refractory carbide.

21. A method according to claim 17, wherein said casting step comprises a hot isostatic pressing step.

* * * * *